US007265736B2

(12) United States Patent
Lee et al.

(10) Patent No.: US 7,265,736 B2
(45) Date of Patent: Sep. 4, 2007

(54) METHOD AND APPARATUS FOR REDUCING FALSE CONTOUR IN DIGITAL DISPLAY PANEL USING PULSE NUMBER MODULATION

(75) Inventors: Ho-young Lee, Kyungki-do (KR); Chang-yeong Kim, Kyungki-do (KR); Young-sun Kim, Kyungki-do (KR); Koichi Sono, Kyungki-do (KR); Chang-wan Hong, Kyungki-do (KR)

(73) Assignee: Samsung Electronics Co., Ltd., Suwon, Kyungki-do (KR)

( * ) Notice: Subject to any disclaimer, the term of this patent is extended or adjusted under 35 U.S.C. 154(b) by 439 days.

(21) Appl. No.: 10/648,643

(22) Filed: Aug. 27, 2003

(65) Prior Publication Data

US 2004/0070590 A1 Apr. 15, 2004

(30) Foreign Application Priority Data

Oct. 9, 2002 (KR) ..... 10-2002-0061494

(51) Int. Cl.
*G09G 3/28* (2006.01)

(52) U.S. Cl. ..... 345/60; 345/690

(58) Field of Classification Search ..... 345/60–72, 345/690

See application file for complete search history.

(56) References Cited

U.S. PATENT DOCUMENTS 6,025,818 A * 2/2000 Okano ..... 345/63

(Continued)

FOREIGN PATENT DOCUMENTS

EP 0 822 536 A2 2/1998

(Continued)

OTHER PUBLICATIONS

T. Kurita et al., "A 42-Inch-Diagonal HDTV Plasma Display", Science and Technical Research Laboratories, IEEE, 1997, New York, New York, USA, pp. 55-58.

(Continued)

*Primary Examiner*—Amr A. Awad
*Assistant Examiner*—Steven E Holton
(74) *Attorney, Agent, or Firm*—Buchanan Ingersoll & Rooney PC

(57) ABSTRACT

A method and apparatus for reducing false contour in a digital display apparatus including a plasma display panel (PDP) using pulse number modulation are provided. The apparatus includes a data converter, which processes an image signal such that a gray level of the image signal exists within a predetermined range; an error diffuser, which diffuses an error between a gray level of a current pixel in a current frame of the image signal and a gray level of the current pixel in the current frame after being subjected to gray-level change, to pixels adjacent to the current pixel in the current frame; a gray-level changing unit, which calculates a difference in a gray level between each pixel in the current frame of the image signal and a pixel corresponding to the current frame pixel in a previous frame of the image signal, and changes the gray level of the current frame pixel based on the gray level difference such that transition in an emission pattern of higher weighted subfields among subfields, which illuminate according to the gray level of the current frame pixel, between the current frame pixel and the previous frame pixel is minimized; and a subfield converter, which converts a subfield according to a gray level output from the gray-level changing unit.

34 Claims, 13 Drawing Sheets

U.S. PATENT DOCUMENTS

| | | | | |
|---|---|---|---|---|
| 6,052,491 | A | 4/2000 | Clatanoff et al. | |
| 6,088,012 | A | 7/2000 | Shigeta et al. | |
| 6,097,368 | A | 8/2000 | Zhu et al. | |
| 6,268,890 | B1 | 7/2001 | Kawahara | |
| 6,310,588 | B1 | 10/2001 | Kawahara et al. | |
| 6,590,616 | B1 * | 7/2003 | Takeuchi | 348/572 |
| 6,774,873 | B2 * | 8/2004 | Hsu et al. | 345/60 |

FOREIGN PATENT DOCUMENTS

| | | |
|---|---|---|
| EP | 0 822 536 A3 | 3/1998 |
| EP | 0 973 147 A1 | 1/2000 |
| JP | 8234694 | 9/1996 |

OTHER PUBLICATIONS

I. Kawahara et al, "Dynamic Gray-Scale Control to Reduce Motion-Picture Disturbance for High-Resolution PDPs", SID International Symposium Digest of Technical Papers, 1999, vol. 30, San Jose, California, USA, pp. 166-169.

English Translation of Korean Patent Office Action in corresponding application.

European Patent Office Search Report in corresponding application.

* cited by examiner

FIG. 5

| GRAY LEVEL | PIXEL GROUP NUMBER | D0 | D1 | D2 | D3 | D4 | D5 | D6 | D7 | D8 | D9 |
|---|---|---|---|---|---|---|---|---|---|---|---|
| 0~D3×1-1 | 0 | BINARY | | | × | × | × | × | × | × | × |
| D3×1~D3×2-1 | 1 | | | | ● | × | × | × | × | × | × |
| D3×2~D3×3-1 | 2 | | | | × | ● | × | × | × | × | × |
| D3×3~D3×4-1 | 3 | | | | ● | ● | × | × | × | × | × |
| D3×4~D3×5-1 | 4 | | | | ● | × | ● | × | × | × | × |
| D3×5~D3×6-1 | 5 | | | | × | ● | ● | × | × | × | × |
| D3×6~D3×7-1 | 6 | | | | ● | ● | ● | × | × | × | × |
| D3×7~D3×8-1 | 7 | | | | ● | ● | × | ● | × | × | × |
| D3×8~D3×9-1 | 8 | | | | ● | × | ● | ● | × | × | × |
| D3×9~D3×10-1 | 9 | | | | × | ● | ● | ● | × | × | × |
| D3×10~D3×11-1 | 10 | | | | ● | ● | ● | ● | × | × | × |
| D3×11~D3×12-1 | 11 | | | | ● | ● | ● | × | ● | × | × |
| D3×12~D3×13-1 | 12 | | | | ● | ● | × | ● | ● | × | × |
| D3×13~D3×14-1 | 13 | | | | ● | × | ● | ● | ● | × | × |
| D3×14~D3×15-1 | 14 | | | | × | ● | ● | ● | ● | × | × |
| D3×15~D3×16-1 | 15 | | | | ● | ● | ● | ● | ● | × | × |
| D3×16~D3×17-1 | 16 | | | | ● | ● | ● | × | ● | ● | × |
| D3×17~D3×18-1 | 17 | | | | ● | ● | × | ● | ● | ● | × |
| D3×18~D3×19-1 | 18 | | | | ● | × | ● | ● | ● | ● | × |
| D3×19~D3×20-1 | 19 | | | | × | ● | ● | ● | ● | ● | × |
| D3×20~D3×21-1 | 20 | | | | ● | ● | ● | ● | ● | ● | × |
| D3×21~D3×22-1 | 21 | | | | ● | ● | ● | × | ● | ● | ● |
| D3×22~D3×23-1 | 22 | | | | ● | ● | × | ● | ● | ● | ● |
| D3×23~D3×24-1 | 23 | | | | ● | × | ● | ● | ● | ● | ● |
| D3×24~D3×25-1 | 24 | | | | × | ● | ● | ● | ● | ● | ● |
| D3×25~D3×26-1 | 25 | | | | | | | | ● | | ● |

FIG. 10

| GRAY LEVEL | WEIGHT ON SUBFIELD | | | | | | | | | |
|---|---|---|---|---|---|---|---|---|---|---|
| | 1 | 2 | 4 | 8 | 16 | 24 | 32 | 40 | 56 | 72 |
| 0 | × | × | × | × | × | × | × | × | × | × |
| 1 | ● | × | × | × | × | × | × | × | × | × |
| 3 | ● | ● | × | × | × | × | × | × | × | × |
| 7 | ● | ● | ● | × | × | × | × | × | × | × |
| 15 | ● | ● | ● | ● | × | × | × | × | × | × |
| 31 | ● | ● | ● | ● | ● | × | × | × | × | × |
| 55 | ● | ● | ● | ● | ● | ● | × | × | × | × |
| 87 | ● | ● | ● | ● | ● | ● | ● | × | × | × |
| 127 | ● | ● | ● | ● | ● | ● | ● | ● | × | × |
| 183 | ● | ● | ● | ● | ● | ● | ● | ● | ● | × |
| 255 | ● | ● | ● | ● | ● | ● | ● | ● | ● | ● |

FIG. 11

| PIXEL GROUP NUMBER | D3 | D4 | D5 | D6 | D7 | D8 | D9 |
|---|---|---|---|---|---|---|---|
| 0 | × | × | × | × | × | × | × |
| 1 | ● | × | × | × | × | × | × |
| 2 | × | ● | × | × | × | × | × |
| 3 | ● | ● | × | × | × | × | × |
| 4 | ● | × | ● | × | × | × | × |
| 5 | × | ● | ● | × | × | × | × |
| 6 | ● | ● | ● | × | × | × | × |
| 7 | ● | ● | × | ● | × | × | × |
| 8 | ● | × | ● | ● | × | × | × |
| 9 | × | ● | ● | ● | × | × | × |
| 10 | ● | ● | ● | ● | × | × | × |
| 11 | ● | ● | ● | × | ● | × | × |
| 12 | ● | ● | × | ● | ● | × | × |
| 13 | ● | × | ● | ● | ● | × | × |
| 14 | × | ● | ● | ● | ● | × | × |
| 15 | ● | ● | ● | ● | ● | × | × |
| 16 | ● | ● | ● | × | ● | ● | × |
| 17 | ● | ● | × | ● | ● | ● | × |
| 18 | ● | × | ● | ● | ● | ● | × |
| 19 | × | ● | ● | ● | ● | ● | × |
| 20 | ● | ● | ● | ● | ● | ● | × |
| 21 | ● | ● | ● | × | ● | ● | ● |
| 22 | ● | ● | × | ● | ● | ● | ● |
| 23 | ● | × | ● | ● | ● | ● | ● |
| 24 | × | | | | | | |
| 25 | | | | | | | |

FIG. 12

| PIXEL GROUP NUMBER | CONVERSION OF HIGHER WEIGHTED SUBFIELDS | |
|---|---|---|
| | FIRST REPRESENTATION | SECOND REPRESENTATION |
| 0 | 0 | 0 |
| 1 | 1 | 1 |
| 2 | 2 | 2 |
| 3 | 3 | 3 |
| 4 | 4 | 4 |
| 5 | 4,5,6 | 3,4,5,6,7 |
| 6 | 5,6,7 | 4,5,6,7,8 |
| 7 | 6,7,8 | 5,6,7,8,9 |
| 8 | 7,8,9 | 6,7,8,9,10 |
| 9 | 8,9,10 | 7,8,9,10,11 |
| 10 | 9,10,11 | 8,9,10,11,12 |
| 11 | 10,11,12 | 9,10,11,12,13 |
| 12 | 11,12,13 | 10,11,12,13,14 |
| 13 | 12,13,14 | 11,12,13,14,15 |
| 14 | 13,14,15 | 12,13,14,15,16 |
| 15 | 14,15,16 | 13,14,15,16,17 |
| 16 | 15,16,17 | 14,15,16,17,18 |
| 17 | 16,17,18 | 15,16,17,18,19 |
| 18 | 17,18,19 | 16,17,18,19,20 |
| 19 | 18,19,20 | 17,18,19,20,21 |
| 20 | 19,20,21 | 18,19,20,21,22 |
| 21 | 20,21,22 | 19,20,21,22,23 |
| 22 | 21,22,23 | 20,21,22,23,24 |
| 23 | 22,23,24 | 21,22,23,24,25 |
| 24 | 23,24,25 | 22,23,24,25 |
| 25 | 24,25 | 23,24,25 |

FIG. 13

| SIGN BIT (ONE BIT) | DIFFERENCE DATA (TWO BITS) |
|---|---|

| SIGN BIT | DIFFERENCE DATA | OUTPUT DIFFERENCE DATA |
|---|---|---|
| 0 | 00 | 0 |
| | 01 | 1 |
| | 10 | 2 |
| | 11 | 3 |
| 1 | 00 | 0 |
| | 01 | −1 |
| | 10 | −2 |
| | 11 | −3 |

METHOD AND APPARATUS FOR REDUCING FALSE CONTOUR IN DIGITAL DISPLAY PANEL USING PULSE NUMBER MODULATION

CROSS-REFERENCE TO RELATED APPLICATIONS

This application claims the priority of Korean Patent Application No. 2002-61494, filed on Oct. 9, 2002, which is incorporated herein in its entirety by reference.

BACKGROUND OF THE INVENTION

1. Field of the Invention

The present invention relates to a method and apparatus for reducing false contour in a digital display apparatus including a plasma display panel using pulse number modulation.

2. Description of the Related Art

With the development of large display apparatuses along with the commencement of high-definition television (HDTV) broadcast, super-thin and large display apparatuses such as plasma display panel (PDP) displays and digital micromirror device (DMD) displays have been spotlighted. Unlike a cathode-ray tube (CRT) using a current driving method, such matrix display panels display a gray level using pulse number modulation. One TV field is divided into a plurality of subfields in a time domain, and a gray level is displayed using combinations of brightness values of the individual subfields, which are controlled based on the number of sustain pulses during a sustain period for each subfield. In such methods of displaying a gray level using pulse number modulation, an emission position of each subfield inevitably changes depending on an input gray level in the time domain. Although a gray level for still images can be displayed without distortion, false contour not existing on an original image occurs in moving images since an emission position of each subfield significantly changes at even a slight change in an input gray level. In other words, emission pattern change in the time domain is spatially expressed, thereby provoking false contour.

FIG. 1 illustrates an illuminating method used in PDPs. The horizontal axis indicates time, and the vertical axis indicates the number of horizontal scan lines. One field is divided into a plurality of subfields, and each subfield is divided into an address period and a sustain period. During the sustain period, a PDP cell is discharged using a sustain pulse so that the sustain period is maintained for a period of time corresponding to a luminance weight depending on a gray level of an input image, and the gray level of image information is displayed by selectively combining the subfields.

FIG. 2 shows an example of occurrence of false contour. One frame is composed of 8 subfields, and subfields have a luminance weight ratio of 1:2:4:8:16:32:64:128 and gray levels of 127 (pixel A) and 128 (pixel B). When a human retina moves to the right by one pixel in parallel during one field period, a gray level integrated on the human retina is expressed through the integration of subfields in the time direction. Accordingly, when there is a great difference in the emission pattern of a subfield at the same position due to, for example, a motion in a moving image, a gray level having a completely different brightness value than the brightness value of an original input pixel is spatially perceived by the retina, thereby provoking false contour.

In order to solve the problem of false contour, there have been proposed selected combination of subfields for minimizing emission pattern transition associated with a large luminance weight, methods of inserting an equalizing pulse at a position where occurrence of false contour is predicted, and methods of scattering false contour.

In the selected combination of subfields (disclosed in U.S. Pat. Nos. 6,268,890 B1 and 6,310,588 B1), subfields are arranged in substantially increasing or decreasing order of luminance weights, and a subfield combination minimizing the number of subfields with large luminance weights that are "on" is selected out of subfield combinations for which displaying a gray level is possible, thereby reducing occurrences of false contour. In this method, a change in "on/off" subfield diffusion is temporally dispersed, thereby reducing occurrences of false contour. However, since illuminating pattern transition of subfields with relatively large luminance weights is not completely eliminated, false contour cannot be efficiently eliminated. In addition, a large motion causes an error to be large, and thus noise is easily perceived due to error diffusion.

In a method using an equalizing pulse (disclosed in U.S. Pat. No. 6,097,368), the transition between subfields that may cause false contour is detected, and an equalizing pulse is inserted before the transition occurs. In order to obtain an accurate equalizing pulse, an elaborate motion estimator is required. Accordingly, this method is difficult to practically use. In order to overcome this problem, a plurality of optimal equalizing pulse codes are calculated with respect to a current brightness value off line and then stored, and an optimal equalizing pulse code minimizing false contour is selected using the brightness values of corresponding two pixels between current and previous fields. However, there is a limit to efficiently eliminating false contour.

In a method of scattering false contour (disclosed in U.S. Pat. No. 6,088,012), subfields with relatively higher luminance weights are divided into smaller subfields having divided weights, and the smaller subfields are scattered in a field. However, since the higher luminance weights having a large time interval is used to display high gray levels in a moving image, blurring occurs in moving images.

SUMMARY OF THE INVENTION

The present invention provides a method and apparatus for reducing false contour in a digital display apparatus including a plasma display panel using pulse number modulation.

The present invention also provides an apparatus for driving a digital display apparatus including a plasma display panel using pulse number modulation and including apparatus for reducing false contour.

According to an aspect of the present invention, there is provided an apparatus for reducing false contour in a digital display panel. The apparatus includes a data converter, which processes an image signal such that a gray level of the image signal exists within a predetermined range; an error diffuser, which diffuses an error between a gray level of a current pixel in a current frame of the image signal received from the data converter and a gray level of the current pixel in the current frame after being subjected to gray-level change, to pixels adjacent to the current pixel in the current frame; a first gray-level changing unit, which receives the image signal from the error diffuser, calculates a difference in a gray level between each pixel in the current frame of the image signal and a pixel corresponding to the current frame pixel in a previous frame of the image signal, and changes the gray level of the current frame pixel based on the gray level difference such that transition in an emission pattern of higher weighted subfields among subfields, which illuminate according to the gray level of the current frame pixel, between the current frame pixel and the previous frame pixel is minimized; and a subfield converter, which converts a subfield according to a gray level output from the first gray-level changing unit.

Preferably, the subfield converter represents the gray levels of subfields in the image signal with weights D0 through D9 in an increasing order from a lower to a higher value according to a predetermined rule such that the weights D0, D1, D2, D3, D4, D5, and D6 are arranged in an arithmetical progression so that D3=D0+D1+D2+1, D4=D3+d, D5=D4+d, and D6=D5+d and such that the weights D7, D8, and D9 satisfy D7=D8=D9=D6+d.

Preferably, the subfield converter represents the gray levels of subfields in the image signal with weights D0 through D9 in an increasing order from a lower to a higher value according to a predetermined rule such that highest weights D7, D8, and D9 do not allow emission pattern transition to occur with an increase in the gray level of the image signal, and such that higher weights D3, D4, D5, and D6 allow an off state to have a regular distribution with the increase in the gray level of the image signal.

Alternatively, the subfield converter may represent the gray levels of subfields in the image signal with weights D0 through D9 in an increasing order from a lower to a higher value according to a predetermined rule such that an emission pattern is changed only at the weights D0, D1, D2, D3, D4, D5, and D6 with a change in the gray level of the image signal.

Preferably, the first gray-level changing unit includes a frame memory part, which receives the image signal from the data converter and stores information on a currently input frame as previous frame information for a next input frame; an pixel transition determiner, which receives current frame information of the image signal from the error diffuser and the previous frame information from the frame memory part and determines a degree of gray-level transition between each pixel in the current frame and a corresponding pixel in the previous frame; a still image determiner, which receives the degree of gray-level transition from the pixel transition determiner and determines whether the current frame is a still image based on the degree of gray-level transition and a predetermined level; a pixel group number storage part, which stores pixel group number information regarding to each pixel in the previous frame based on the gray level of the pixel after being subjected to the gray-level change; and a second gray-level changing unit, which when the still image determiner determines the current frame as not a still image, changes the gray level of the current frame according to a predetermined method using the current frame information output from the error diffuser, the degree of gray-level transition output from the pixel transition determiner, the previous frame information stored in the frame memory part, and the pixel group number information stored in the pixel group number storage part.

Preferably, the second gray-level changing unit outputs a gray level of the previous frame when the still image determiner determines the current frame as a still image.

Preferably, the pixel transition determiner determines the degree of gray-level transition between a particular pixel in the current frame, i.e., a current frame pixel, and a corresponding pixel in the previous frame, i.e., a previous frame pixel, using an average of gray level of all pixels included in a square block that has a predetermined size and has the current frame pixel at its center, an average of absolute values of the gray levels of all of the pixels included in the square block except for the current frame pixel, an average of absolute values of differences between the gray levels of all of the pixels included in the square block and respective gray levels of all pixels included in a square block that has the predetermined size and has the previous frame pixel at its center, and an absolute value of a difference between the gray level of the current frame pixel and the gray level of the previous frame pixel.

Preferably, the still image determiner determines the current frame as a still image when a ratio of the number of pixels, which are determined as having less motion than a predetermined amount in the current frame of the image signal received from the pixel transition determiner, to a total number of pixels in the current frame is greater than the predetermined value.

Preferably, the second gray-level changing unit compares the degree of gray-level transition from the pixel transition determiner with a predetermined level and changes the gray level of each pixel in the current frame based on the result of the comparison.

Preferably, the second gray-level changing unit compares the degree of gray-level transition from the pixel transition determiner with a predetermined level and when the degree of gray-level transition is lower than the predetermined level and when a pixel group number of a pixel in the current frame, i.e., the current frame pixel, is different from a pixel group number of a corresponding pixel in the previous frame, i.e., the previous frame pixel, changes the pixel group number of the current frame pixel to a pixel group number close to the pixel group number of the previous frame pixel among pixel group numbers adjacent to the pixel group number of the current frame pixel Preferably, when the subfield converter represents the gray levels of subfields in the image signal with weights D0 through D9 in an increasing order from a lower to a higher value according to a predetermined rule, the second gray-level changing unit changes weights representing the gray level of the current frame pixel such that an emission pattern of the current frame is the same as that of the previous frame with respect to the weights D3, D4, and D5.

Preferably, when the subfield converter represents the gray levels of subfields in the image signal with weights D0 through D9 in an increasing order from a lower to a higher value according to a predetermined rule, the second gray-level changing unit changes weights representing the gray level of the current frame pixel such that a distribution of on states at the weights D3, D4, D5, and D6 is regular in a diagonal direction when the on states of the weights D0 through D9 are arranged in an increasing order of the gray levels.

According to another aspect of the present invention, there is provided a method of reducing false contour in a digital display panel. The method includes (a) processing an image signal such that a gray level of the image signal exists within a predetermined range; (b) diffusing an error between a gray level of a current pixel in a current frame of the image signal resulting from step (a) and a gray level of the current pixel in the current frame after being subjected to gray-level change to pixels adjacent to the current pixel in the current frame; (c) calculating a difference in a gray level between each pixel in the current frame of the image signal resulting from step (b) and a pixel corresponding to the current frame pixel in a previous frame of the image signal resulting from step (b), and changing the gray level of the current frame pixel based on the gray level difference such that higher weighted subfields among subfields, which illuminate according to the gray level of the current frame pixel, are on a continuous on or off state; and (d) converting a subfield according to a gray level resulting from step (c).

Preferably, step (d) includes representing the gray levels of subfields in the image signal with weights D0 through D9 in an increasing order from a lower to a higher value according to a predetermined rule such that the weights D0, D1, D2, D3, D4, D5, and D6 are arranged in an arithmetical progression so that D3=D0+D1+D2+1, D4=D3+d, D5=D4+d, and D6=D5+d and such that that weights D7, D8, and D9 satisfy D7=D8=D9=D6+d.

Preferably, step (d) includes representing the gray levels of subfields in the image signal with weights D0 through D9 in an increasing order from a lower to a higher value according to a predetermined rule such that highest weights D7, D8, and D9 do not allow emission pattern transition to occur with an increase in the gray level of the image signal, and such that higher weights D3, D4, D5, and D6 allow an off state to have a regular distribution with the increase in the gray level of the image signal.

Preferably, step (c) includes (c1) storing information on a currently input frame of the image signal resulting from step (a) as previous frame information for a next input frame; (c2) determining a degree of gray-level transition between each pixel in the current frame and a corresponding pixel in the previous frame based on current frame information of the image signal resulting from step (a) and the previous frame information resulting from step (c1); (c3) determining whether the current frame is a still image based on the degree of gray-level transition and a predetermined level; (c4) storing pixel group number information regarding to each pixel in the previous frame based on the gray level of the pixel after being subjected to the gray-level change; and (c5) when the current frame is determined as not a still image, changing the gray level of the current frame according to a predetermined method using the current frame information, the degree of gray-level transition, the previous frame information, and the pixel group number information.

Preferably, step (c5) comprises outputting a gray level of the previous frame when the current frame is determined as a still image in step (c3).

Preferably, step (c2) comprises determining the degree of gray-level transition between a particular pixel in the current frame, i.e., a current frame pixel, and a corresponding pixel in the previous frame, i.e., a previous frame pixel, using an average of gray level of all pixels included in a square block that has a predetermined size and has the current frame pixel at its center, an average of absolute values of the gray levels of all of the pixels included in the square block except for the current frame pixel, an average of absolute values of differences between the gray levels of all of the pixels included in the square block and respective gray levels of all pixels included in a square block that has the predetermined size and has the previous frame pixel at its center, and an absolute value of a difference between the gray level of the current frame pixel and the gray level of the previous frame pixel.

Preferably, step (c3) comprises determining the current frame as a still image when a ratio of the number of pixels, which are determined as having less motion than a predetermined amount in the current frame of the image signal in step (c2), to a total number of pixels in the current frame is greater than a predetermined value.

Preferably, step (c5) comprises comparing the degree of gray-level transition resulting from step (c2) with a predetermined level and changing the gray level of each pixel in the current frame based on the result of the comparison.

Preferably, step (c5) comprises comparing the degree of gray-level transition resulting from step (c2) with a predetermined level and when the degree of gray-level transition is lower than the predetermined level and when a pixel group number of a pixel in the current frame, i.e., the current frame pixel, is different from a pixel group number of a corresponding pixel in the previous frame, i.e., the previous frame pixel, changing the pixel group number of the current frame pixel to a pixel group number close to the pixel group number of the previous frame pixel among pixel group numbers adjacent to the pixel group number of the current frame pixel.

Preferably, when the gray levels of subfields in the image signal are represented with weights D0 through D9 in an increasing order from a lower to a higher value according to a predetermined rule, step (c5) comprises changing weights representing the gray level of the current frame pixel such that an emission pattern of the current frame is the same as that of the previous frame with respect to the weights D3, D4, and D5.

Preferably, when the gray levels of subfields in the image signal are represented with weights D0 through D9 in an increasing order from a lower to a higher value according to a predetermined rule, step (c5) comprises changing weights representing the gray level of the current frame pixel such that a distribution of on states at the weights D3, D4, D5, and D6 is regular in a diagonal direction when the on states of the weights D0 through D9 are arranged in an increasing order of the gray levels.

Preferably, when the gray level of the image signal is divided into 25 gray levels according to a predetermined standard and then pixel group numbers from zero are sequentially allocated to the 25 gray levels, step (c5) comprises not changing gray levels corresponding to the pixel group numbers 0 and 5.

BRIEF DESCRIPTION OF THE DRAWINGS

The above and other features and advantages of the present invention will become more apparent by describing in detail preferred embodiments thereof with reference to the attached drawings in which:

FIG. 5 is a diagram of a preferred embodiment of emission patterns in subfield conversion according to the present invention;

FIG. 10 is a diagram of a preferred embodiment of the continuous on state of a subfield according to the present invention;

FIG. 11 is a diagram for explaining transition of higher illuminating blocks in each pixel having a different pixel group number according to the present invention;

FIG. 12 is a diagram for explaining a preferred embodiment of a method of converting a higher illuminating block according to the present invention;

FIG. 13 is a diagram for explaining a preferred embodiment of the configuration of pixel group number difference data according to the present invention;

DETAILED DESCRIPTION OF THE INVENTION

Hereinafter, preferred embodiments of the present invention will be described in detail with reference to the attached drawings. The present invention is provided in order to effectively reduce false contour which inevitably occurs when a flat matrix display apparatus such as a plasma display panel (PDP) displays the gray level of a moving image. The present invention configures luminance weights on subfields such that emission pattern transition occurs only at relatively small luminance weights, thereby suppressing the occurrence of false contour, and changes the gray level of a current frame pixel such that the influence of a motion between a previous frame pixel and the current frame pixel, which are located at the same spatial position, on the emission pattern transition of a subfield is minimized, thereby reducing a degree of false contour. In the meantime, in order to minimize image distortion due to an error between an input signal and a changed signal generated by adjusting the gray level of the input signal, the error is diffused to peripheral pixels so that and error in a gray level between the input signal and an actually displayed signal is counterbalanced. In the present invention, a gray level is adjusted depending on the amount of motion so that an error is small where motion is small. Even if motion is large, since a gray level minimizing the emission pattern transition of relatively higher weighted subfields between a previous frame pixel and a current input pixel exists among gray levels that are adjacent to the gray level of the current input pixel with a small difference therefrom, the degree of perception of diffused noise due to error diffusion is reduced.

Figure 1:
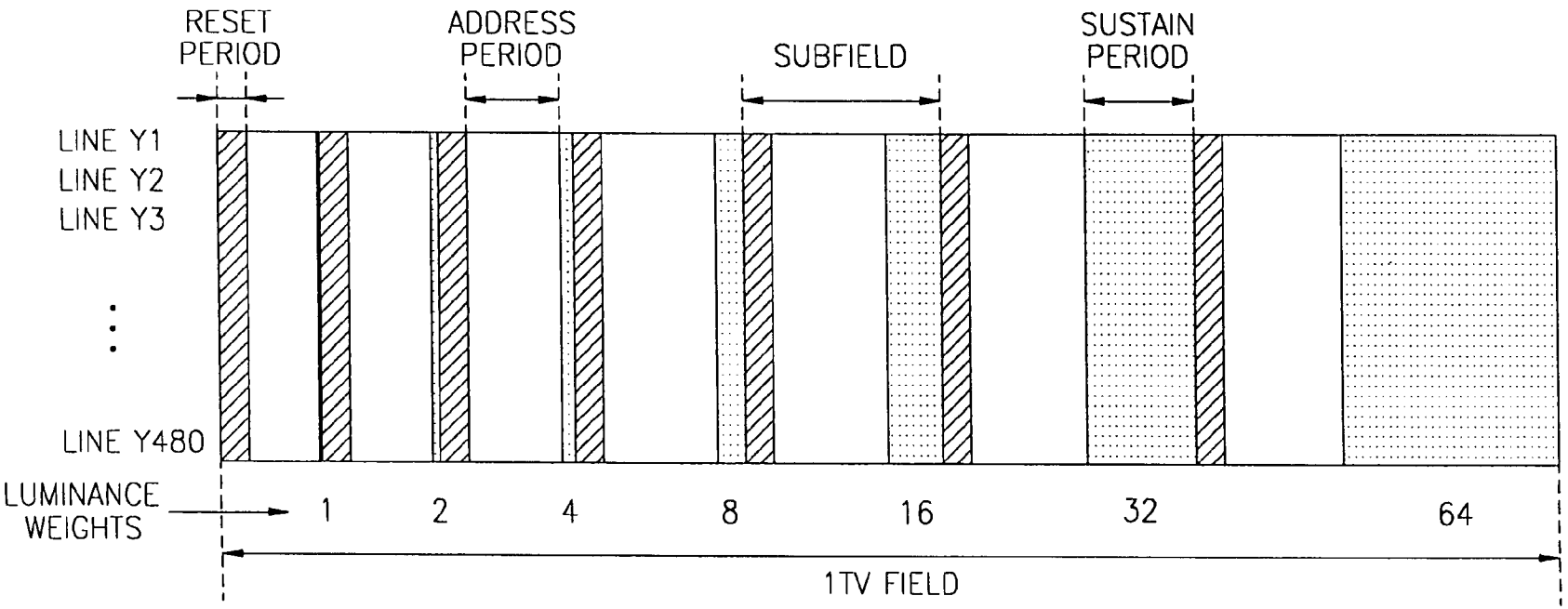
FIG. 1 (PRIOR ART)
FIG. 1 is a diagram for explaining an emission method used in a plasma display panel (PDP)
Figure 2:
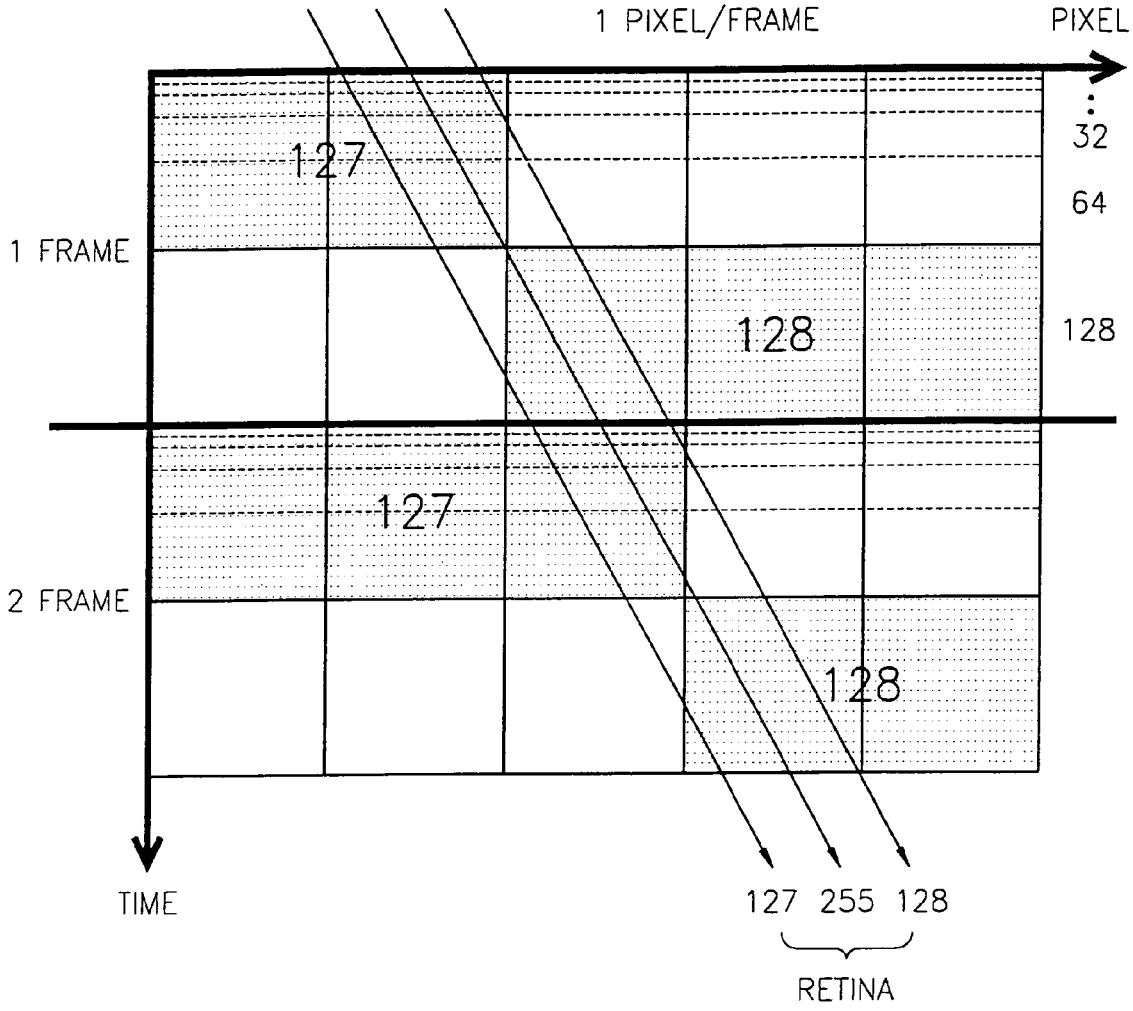
FIG. 2 (PRIOR ART)
FIG. 2 is a diagram showing an example of occurrence of false contour.
Figure 3:
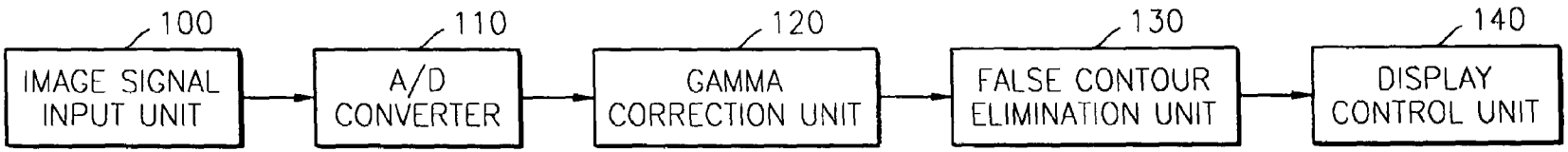
FIG. 3 is a block diagram of an apparatus for driving a PDP according to a preferred embodiment of the present invention.

FIG. 3 is a block diagram of an apparatus for driving a PDP according to a preferred embodiment of the present invention. An image signal input unit 100 separates only an image signal from an input composite image signal. And analog-to-digital (A/D) converter 110 converts the separated analog image signal to a digital image signal. A gamma correction unit 120 corrects an image signal, which is configured to be suited to cathode-ray tube (CRT) characteristics, to be suited to PDP characteristics. A false contour elimination unit 130 converts subfields by changing the gray level of an input image signal depending on the amount of motion so that false contour is minimized. A display control unit 140 displays the input image signal that have been coded based on subfields on a PDP.

Figure 4:
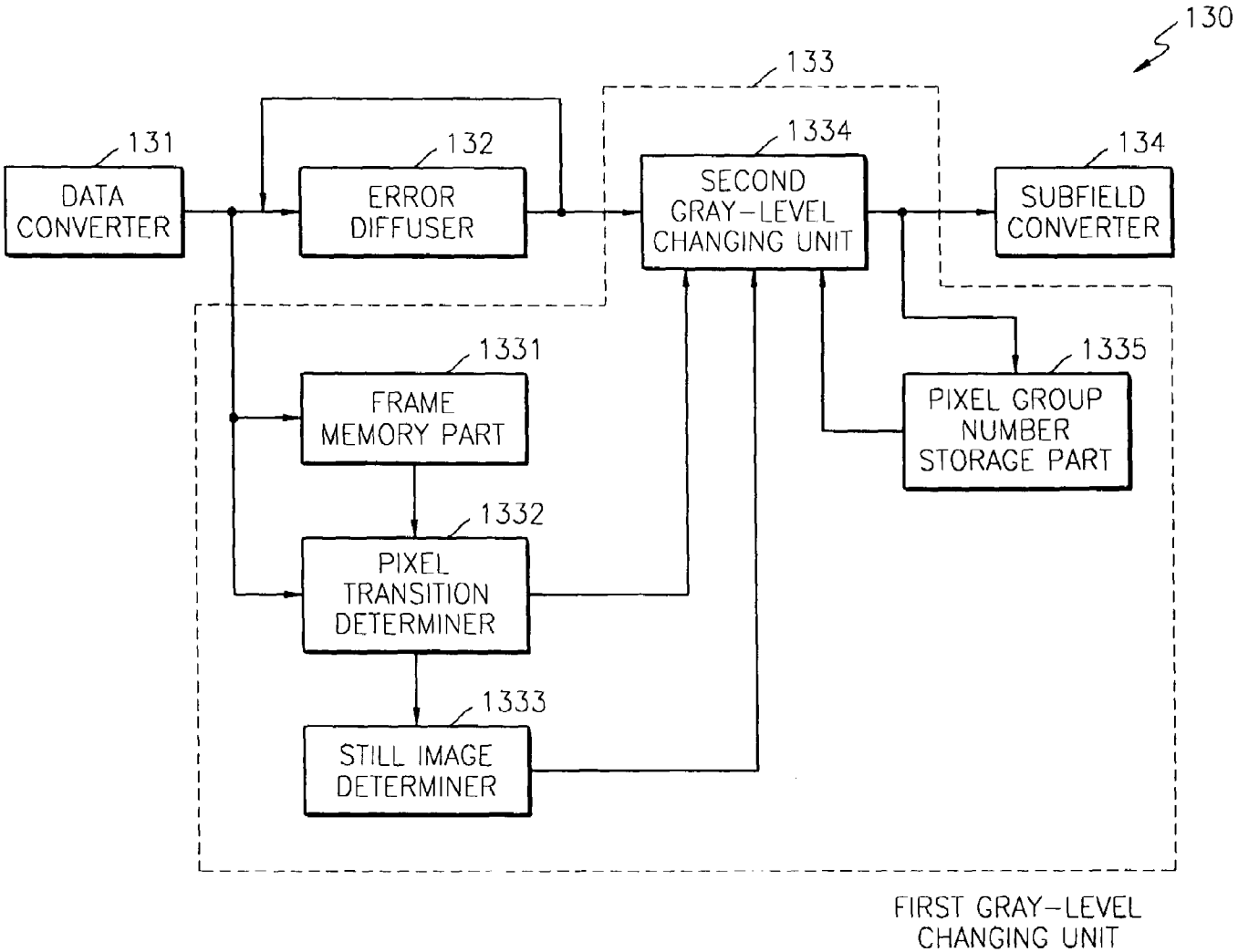
FIG. 4 is a block diagram of a false contour elimination unit shown in FIG. 3.

FIG. 4 is a block diagram of the false contour elimination unit 130 shown in FIG. 3. In the false contour elimination unit 130, a data converter 131 operates to make input data exist within a predetermined gray-level range. An error diffuser 132 diffuses an error to peripheral pixels in order to minimize image distortion due to the error between an original signal and a gray-level changed signal. A first gray-level changing unit 133 receives the image signal from the error diffuser 132, obtains a gray-level difference between each pixel in a current frame and the corresponding pixel in a previous frame, changes the gray level of the current frame pixel based on the gray-level difference such that emission pattern transition between current higher weighted subfields and the higher weighted subfields in the previous frame pixel is minimized. A subfield converter 134 converts subfields according to the changed gray level.

The first gray-level changing unit 133 may include an pixel transition determiner 1332, which determines the amount of motion between each pixel in a current frame and the corresponding pixel in a previous frame; a frame memory part 1331, which stores previous frame data; a second gray-level changing unit 1334, which operates to reduce the emission pattern transition of a subfield in units of pixels; a pixel group number storage part 1335, which stores emission pattern information of higher weighted subfields in each previous frame pixel by the spatial positions of previous frame pixels; and a still image determiner 1333, which determines whether an input image signal corresponds to a still image.

Figure 6:
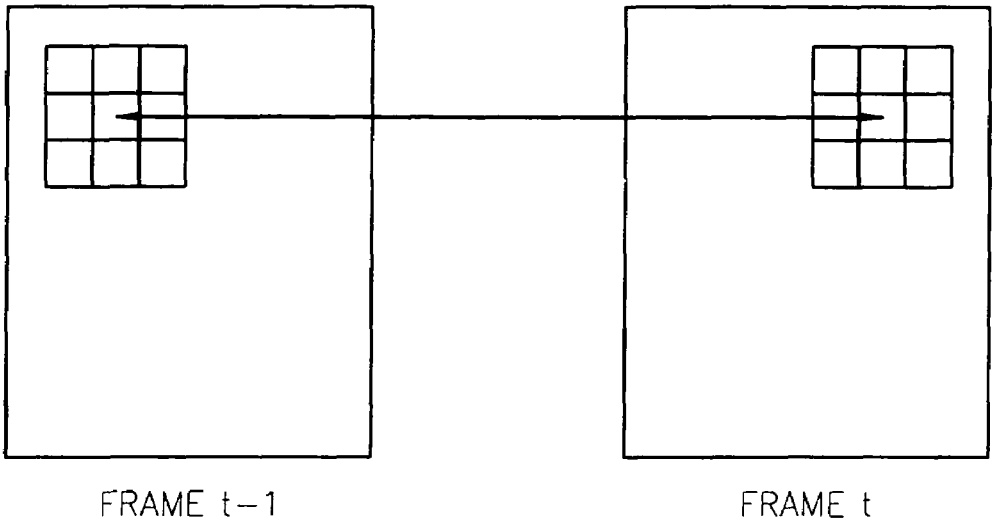
FIG. 6 is a diagram of a preferred embodiment of the operation of an pixel transition determiner shown in FIG. 4.
Figure 7:
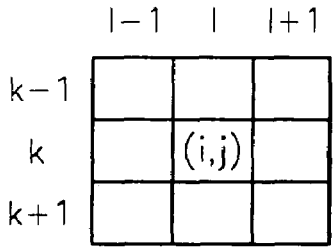
FIG. 7 is a diagram for explaining a preferred embodiment of a mask used for calculating a transition information parameter according to the present invention.
Figure 8:
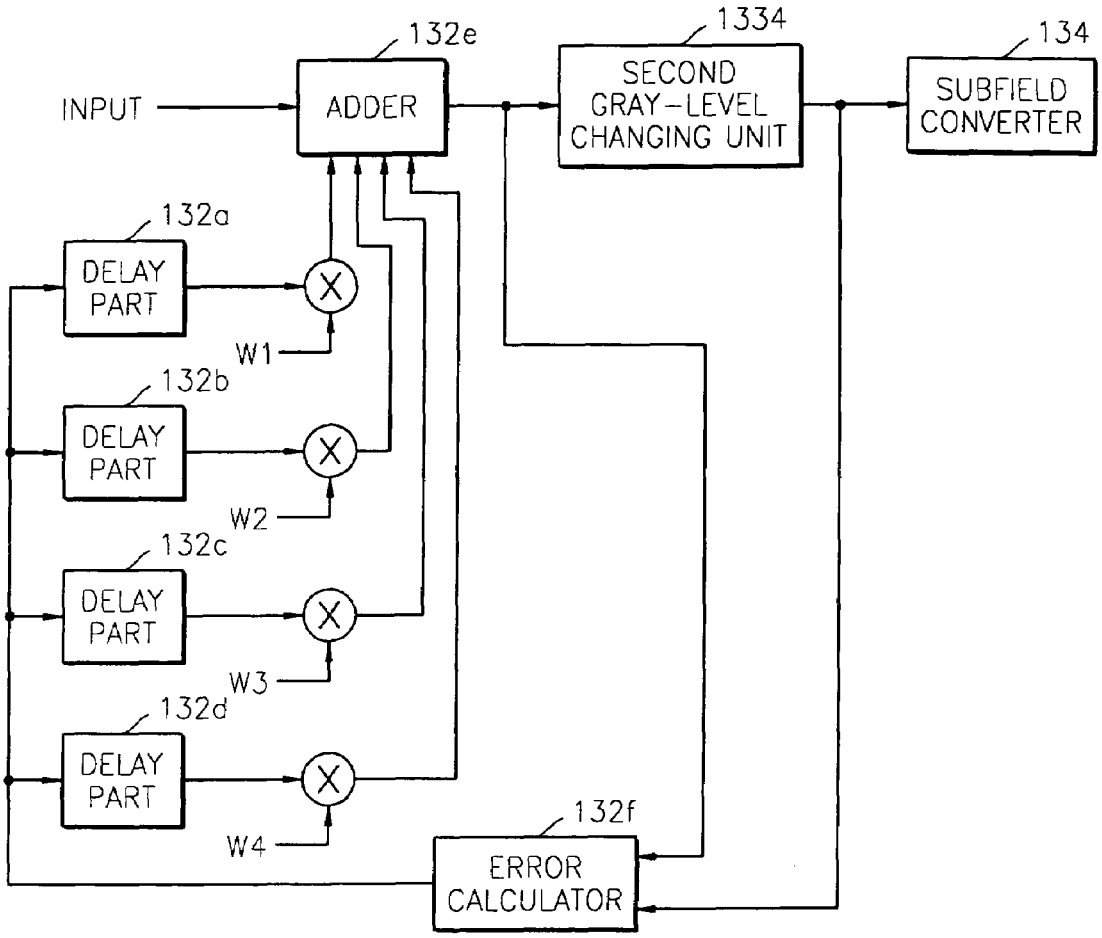
FIG. 8 is a block diagram of a preferred embodiment of the error diffuser shown in FIG. 3.
Figure 9:
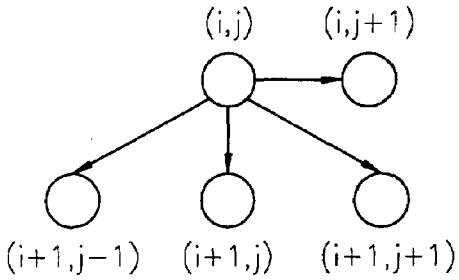
FIG. 9 is a diagram of a preferred embodiment of the application of error diffusion according to the present invention.

FIG. 5 is a diagram of a preferred embodiment of an emission pattern in subfield conversion according to the present invention. FIG. 6 is a diagram of a preferred embodiment of the operation of the pixel transition determiner 1332. FIG. 7 is a diagram for explaining a preferred embodiment of a mask used for calculating a transition information parameter according to the present invention. FIG. 8 is a block diagram of a preferred embodiment of the error diffuser 132 shown in FIG. 3. FIG. 9 is a diagram of a preferred embodiment of the application of error diffusion according to the present invention. FIG. 10 is a diagram of a preferred embodiment of the continuous on state of a subfield according to the present invention. FIG. 11 is a diagram for explaining transition in higher weighted subfields in each pixel having a different pixel group number according to the present invention. FIG. 12 is a diagram for explaining a preferred embodiment of a method of converting a higher weighted subfield according to the present invention. FIG. 13 is a diagram for explaining a preferred embodiment of the configuration of pixel group number difference data according to the present invention. Hereinafter, each member of an apparatus for reducing false contour according to the present invention will be described in detail with reference to FIGS. 5 through 13.

When subfields are configured according to rules used in the present invention, the gray level of an input image with high luminance may be beyond an expressible gray-level range. The data converter 131 converts input data such that an inexpressible gray level can be displayed within the expressible gray-level range in order to display an image without distortion. In an actual implement, input data can be converted using the gamma correction unit 120 shown in FIG. 3. Since human sight cannot easily identify a high-luminance area, influence of data conversion is not much. Generally, as the number of subfields increases, an inexpressible gray-level portion having high luminance becomes very small. With a small number of subfields, an inexpressible gray-level portion having high luminance is large. However, as the number of subfields decreases, an illuminating period increases, and thus maximum luminance increases. Accordingly, when an inexpressible gray-level is more than 200, influence of data conversion is rarely perceived. With a large number of subfields, all of gray levels can be displayed.

The pixel transition determiner 1332 determines a degree of gray-level transition between an original pixel in a previous frame stored in the frame memory part 1331 and a current frame pixel. The pixel transition determiner 1332 uses difference information between pixels. The result of the determination is used to determine the amount of motion between the corresponding two pixels in the respective previous and current frames and determine whether a current input image is a still image. Generally, various types of noise exist in an input image. When using only the difference between pixels, the influence of the noise in the input image is large. Accordingly, the present invention uses 3×3 block data to determine the degree of gray-level transition between pixels. In determining the degree of gray-level transition, as shown in FIG. 6, a 3×3 block having a current frame pixel at its center and a 3×3 block located at the same spatial position as the 3×3 block having the current frame pixel in a previous frame are used to calculate parameters according to Formulae (1) through (4).

$$Mean_{block}(i, j; t) = \frac{1}{9} \times \sum_{k=-1}^{k=1} \sum_{l=-1}^{l=1} x(i+k, j+l; t) \tag{1}$$

$$Var_{block}(i, j; t) = \frac{1}{8} \times \sum_{k=-1}^{k=1} \sum_{l=-1}^{l=1} \left| x(i+k, j+l; t) - x(i, j; t) \right| \tag{2}$$

$$Mean_{Diff}(i, j) = \frac{1}{9} \times \sum_{k=-1}^{k=1} \sum_{l=-1}^{l=1} \left| x(i+k, j+l; t-1) - x(i+k, j+l; t) \right| \tag{3}$$

$$Pixel_{Diff}(i, j) = \left| x(i, j; t-1) - x(i, j; t) \right| \tag{4}$$

Here, t and t−1 indicate the current frame and the previous frame, respectively, k and l indicate the column and row numbers, respectively, of each pixel in the 3×3 block, and i and j indicate together the position of the current or previous frame pixel at the center of the 3×3 block. When $|Mean_{block}(i,j;t)-Mean_{block}(i,j;t-1)|$, $|Var_{block}(i,j;t)-Var_{block}(i,j;t-1)|$, $|Mean_{Diff}(i,j;t)-Mean_{Diff}(i,j;t-1)|$, and $|Pixel_{Diff}(i,j;t)-Pixel_{Diff}(i,j;t-1)|$ are less than a predetermined threshold value, the current frame pixel is determined as having a small motion, and otherwise, the current frame pixel is determined as having a large motion. False contour is not notably perceived in the case of a small motion but is clearly noted in the case of a large motion. Accordingly, in the present invention, a degree of a change in a gray level is determined depending on the amount of motion. In FIG. 4, the still image determiner 1333 determines the current frame as a still image when a ratio of the number of pixels determined as having the small motion to a total number of pixels in the current frame is greater than a predetermined threshold value. Then, information on the current frame is used in converting a gray level of the next frame.

FIG. 5 shows an example of a subfield conversion table used in the present invention. In the subfield conversion table, for subfields, weights D0, D1, D2, D3, D4, D5, and D6 are determined to be arranged in an arithmetical progression so that weights D0, D1, and D2 satisfy D0+D1+D2+1=D3, and weights D3, D4, D5, and D6 satisfy D4=D3+d, D5=D4+d, and D6=D5+d. Weights D7, D8, and D9 for highest weighted subfields are the same, i.e., D7=D8=D9=D6+d. In the present invention, since subfields are arranged in monotone increasing of higher weights, higher weights having a large time interval are not used to express high luminance, thereby preventing blurring from occurring in moving images. In addition, since the highest weighted subfields corresponding to the highest weights D7, D8, and D9 do not make transition from on to off when an input gray level increases, occurrence of false contour can be reduced. Subfields complying with the above described rules can be configured in various ways. For example, when there are ten subfields, they have a weight ratio of 1:2:4:8:16:24:32:40:40:40. When there are eleven subfields, they have a weight ratio of 1:2:4:8:16:24:32:40:40:40:40. As shown in FIG. 5, when subfields are configured to comply with the above described rules, transition (shaded portion) from on to off of the higher weighted subfields corresponding to the higher weights D3 through D9 most influencing the occurrence of false contour is regularly repeated as a gray level increases. Accordingly, the emission pattern of the higher weighted subfields in a current frame pixel having a motion can be effectively made to be the same as that in a previous frame pixel without changing the input gray level of the current frame pixel very much.

FIG. 8 is a detailed block diagram of the error diffuser 1332 diffuses an error occurring between an input signal and an output signal of the second gray-level changing unit 1334 due to gray-level change to four adjacent pixels, as shown in FIG. 9, at different predetermined ratios.

In FIG. 8, a delay part 132*a* delays an error by one pixel period 1D. A delay part 132*b* delays the error by a (one line−one pixel) period 1H-1D. A delay part 132*c* delays the error by one line period 1H. A delay part 132*d* delays the error by a (one line+one pixel) period 1H+1D. Delayed errors are multiplied by the respective predetermined ratios W1, W2, W3, and W4 and then added to the original input values of the respective adjacent pixels.

More specifically, as shown in FIG. 9, 7/16 of an error occurring with respect to the current frame pixel at the spatial position (i,j) are diffused to a pixel at a position (i,j+1), 1/16 of the error is diffused to a pixel at a position (i+1,j−1), 5/16 of the error are diffused to a pixel at a position (i+1,j), and 3/16 of the error is diffused to a pixel at a position (i+1,j+1). Thereafter, encoding is performed on pixel values to which the error is partially added. Since errors are continuously diffused to peripheral pixels and an average of original pixel values is maintained, the lack of gray levels can be overcome, and an average of input pixel values can be maintained.

Usually, since a 12-bit data is input to the error diffuser 1332, and an 8-bit data is output from the second gray-level changing unit 1334, the lower 4 bits are discarded even if a pixel is not changed in its gray level. Accordingly, the operation of the error diffuser 1332 is applied to all of the input pixels.

FIG. 10 shows an example of continuously maintaining the on state of a subfield, without making conversion between ON and OFF depending on an input gray level, in order to fundamentally prevent false contour from occurring. However, in this example, the number of expressible gray levels is small, such as 11 when there are ten subfields, 12 when there are eleven subfields, or 13 when there are twelve subfields. Since the number of expressible gray levels is restricted, an error occurring in a digital image having 256 gray levels is very large. When a subfield is continuously maintained ON, as shown in FIG. 10, usually, gray levels 1 and 2 are expressed as gray level 1, gray levels 3 through 6 are expressed as gray level 3, gray levels 7 through 14 are expressed as gray level 7, gray levels 15 through 30 are expressed as gray level 15, gray levels 31 through 54 are expressed as gray level 31, gray levels 55 through 86 are expressed as gray level 55, gray levels 67 through 126 are expressed as gray level 87, gray levels 127 through 182 are expressed as gray level 127, gray levels 183 through 254 are expressed as gray level 183, and gray level 255 is expressed as gray level 255. Accordingly, a maximum of an error has a very large value of 71, so an error diffusion pattern is easily perceived even if continuously maintaining an on state is applied to only pixels in an area having a large amount of motion. In addition, since about half of all of the 11 expressible gray levels is concentrated in a lower gray-level range from 1 to 30, there are a lot of limits in actually reproducing an image. Moreover, even if an error is small, the influence of error diffusion can be easily perceived in a portion of an image having low gray levels on a PDP, image reproducibility may be degraded.

In the present invention, after determining the existence/non-existence of motion without subdividing the amount of motion of each pixel, transition of illuminating blocks with higher weights is effectively eliminated so that false contour can be prevented from occurring. In FIG. 11, as for the emission pattern of subfields with the weights D3 through D9 having a lot of influence over the occurrence of false contour except for the weights D0 through D2 having slight influence over the occurrence of false contour, when the pixel group number of a current frame pixel is different than that of the corresponding previous frame pixel located at the same spatial position as the current frame pixel due to the occurrence of motion, the ON/OFF state of the higher weighted subfields with the weights D3 through D9 is different between the current and previous frame pixels due to an irregular change in the illuminating pattern, thereby provoking false contour. Accordingly, it needs to change the gray level of the current frame pixel to prevent the higher weighted subfields from making the transition between ON and OFF so that the occurrence of false contour is prevented. When the configuration of subfields according to the present invention is used, as shown in FIG. 11, the weighted subfields with the weights D7 through D9 do not make transition from ON to OFF as a gray level increases. Accordingly, a change in an illuminating position is slight in a time domain, and thus the weighted subfields with the weights D7 through D9 have slight influence over the occurrence of false contour. In the meantime, the illuminating state of the weighted subfields with the weights D3 through D6 irregularly changes with a change in an input gray level and thus the weighted subfields with the weights D3 through D6 have large influence over the occurrence of false contour. Accordingly, it needs to eliminate a temporal change in an illuminating position with respect to the weights D3 through D6 in order to reduce false contour. In the configuration of subfields according to the present invention, the weighted subfields with the weights D3 through D6 having a large temporal change depending on a change in a gray level are regularly repeated so that an error occurring during change of gray levels, which will be described below, is reduced.

FIG. 12 illustrates the conversion of weighted subfields depending on the transition of higher weighted subfields. In FIG. 12, a first representation represents the conversion of weighted subfields of a current input pixel that has a small amount of motion, and a second representation represents the conversion of weighted subfields of a current input pixel that has a large amount of motion. In a PDP, error diffusion can be easily perceived in a portion of an image having low gray levels even if an error is small, so gray-level change is not performed on pixels having pixel group numbers 0 and 1 even if motion occurs. However, when motion occurs in pixels having the other pixel group numbers, the gray level of a current input pixel is changed to have a gray level corresponding to a pixel group number, which is adjacent to the pixel group number of the current input pixel and has the same illuminating pattern of the higher weighted subfields as a previous frame pixel located at the same spatial position as the current input pixel, as shown in FIG. 12.

In the present invention, gray-level change for preventing false contour is performed using motion information, which is acquired with respect to each pixel using a previous frame pixel and a current frame pixel before being subjected to error diffusion, and difference information in a pixel group number between the previous frame pixel and the current frame pixel, the difference information indicating the emission pattern transition of higher weighted subfields between the previous and current frame pixels. However, when a current input pixel has a gray level at the border of a gray-level range in which the transition of a pixel group number occurs, the pixel group number of the current input pixel, i.e., the original pixel, is different from that of the current frame pixel that is coded and displayed on a PDP due to diffusion of an error occurring in a previous pixel in the current frame. Since false contour is influenced by the gray level of a pixel displayed on a PDP, and gray-level change according to the present invention is performed using pixel group number transition information indicating emission pattern transition of higher weighted subfields between a previous frame pixel and a current frame pixel, it needs to obtain the pixel group number of a gray level that was actually displayed.

Accordingly, a difference between the pixel group number of an original previous frame pixel before being subjected to error diffusion and the pixel group number corresponding to the gray level actually displayed for the original previous frame pixel is stored in the pixel group number storage unit 1335 shown in FIG. 4. FIG. 13 shows the configuration of pixel group number difference data, which is composed of one sign bit and two-bit difference data. When determining the amount of motion, original previous frame pixel data is read from the frame memory part 1331, so the pixel group number information of an actually coded previous frame pixel can be recovered using only the pixel group number difference.

The pixel group number information of the actually coded previous frame pixel, which is necessary for gray-level change, is obtained according to Formula (5).

$$\mathrm{Index}_{prev}\{p_e'(i,j;t-1)\}=\mathrm{Index}\{p(i,j;t-1)\}-\mathrm{Index}_{diff}\{p_e'(i,j;t-1)\} \quad (5)$$

Here, the Index function indicates a pixel group number corresponding to an input gray value, $\mathrm{Index}_{diff}$ indicates a difference between the pixel group number of an original previous frame pixel before being subjected to error diffusion and a pixel group number corresponding to a gray value obtained after the original previous frame pixel is coded and subjected to gray-level change, $p_e'(i,j;t-1)$ indicates the gray level of the previous frame pixel after being subjected to gray-level change and error diffusion, and $p(i,j;t-1)$ indicates the gray level of the original previous frame pixel.

When a previous frame is determined as a still image by the still image determiner 1333, the lower four bits of 12-bit input data of a current frame is discarded, and then 8-bit pixel data is output with an increased gray level due to error diffusion. When the previous frame is not a still image, gray-level change is performed based on the amount of motion obtained by the pixel transition determiner 1332 and the pixel group number of a previous frame pixel. When a pixel has a small amount of motion, a pixel group number difference is small. Accordingly, the emission pattern of higher weighted subfields is adjusted as represented by the first representation shown in FIG. 12. The gray-level change can be expressed as Formula (6).

$$\text{if}(\text{index}_{prev}\{p_e'(i,j;t-1)\}<\text{index}\{p_e(i,j;t)\})\ p_e'(i,j;t)=[\text{index}\{p_e(i,j;t)\}-1]\times D_3+D_{3-1}$$

$$\text{if}(\text{index}_{prev}\{p_e'(i,j;t-1)\}>\text{index}\{p_e(i,j;t)\})\ p_e'(i,j;t)=[\text{index}\{p_e(i,j;t)\}+1]\times D_3$$

$$\text{if}(\text{index}_{prev}\{p_e'(i,j;t-1)\}=\text{index}\{p_e(i,j;t)\})\ p_e'(i,j;t)=p_e(i,j;t) \quad (6)$$

Even though the emission pattern transition of higher weighted subfields has slight influence over the occurrence of false contour when there is a small amount of motion, false contour may occur due to a degradation of accuracy in measuring the amount of motion based on a threshold value used for facilitating implementation of hardware. To overcome this problem, in the present invention, even if a current pixel is determined as having a small amount of motion, gray-level change is performed on the current pixel when there exists a pixel group number difference between the current pixel and a previous frame pixel after being coded. Since the pixel group number difference is small when there is a small amount of motion, the current pixel is changed to have a gray level corresponding to a pixel group number closest to the pixel group number of the current pixel based on identification of the magnitudes of the pixel group numbers so that an error due to the gray-level change can be minimized. An error occurring during the gray-level change according to the Formula (6) is so slight that it is not perceived in a moving image, and the influence of motion measurement accuracy is reduced.

In the meantime, since a probability of the occurrence of false contour in a moving image is large when there is a large amount of motion, it is effective in suppressing the occurrence of false contour to make the higher weighted subfields of a current frame pixel have the same on/off state as those of a previous frame pixel. Conventionally, when there is a large amount of motion, subfield illuminating blocks are continuously maintained to be in an on state in order to reduce false contour. As mentioned above, however, an error occurring when a gray level is changed for achieving the continuous on state increases. Moreover, in order to optimize the effect of the continuous on state, all of the pixels in a frame need to be in the continuous on state. Accordingly, the conventional technology of changing the gray levels of only pixels having a large amount of motion such that the pixels are continuously maintained on can partially suppress the occurrence of false contour, but it is not effective.

In the present invention, in order to make the higher illuminating blocks of a current frame pixel have the same ON/OFF state as those of a previous frame pixel, the gray level of the current frame pixel is changed, as shown in the second representation of FIG. 12, depending on the pixel group number of the previous frame pixel after being coded. When the previous frame pixel after being coded and the current frame pixel before being coded have the same pixel group number, the gray level of the current frame pixel before being coded is output as it is. Otherwise, the gray level of the current frame pixel is changed to a gray level corresponding to a pixel group number, which is closest to the current frame pixel and has the same emission pattern of the higher weighted subfields as the previous frame pixel after being coded. In the configuration of subfields according to the present invention, as shown in FIG. 5, the off states of subfields with the weights D3, D4, D5, and D6, which have influence over the occurrence of false contour, are regularly distributed in a diagonal direction. In addition, the subfields of each pixel are turned OFF at only one of the weights D3, D4, D5, and D6 as the pixel group number increases. Accordingly, pixel group numbers having the same emission pattern of higher weighted subfields as a previous frame pixel after being coded are close to the pixel group number of a current frame pixel before being coded. Consequently, during the gray-level change, the occurrence of false contour can be effectively suppressed with only a small error. For example, when the pixel group of a current input pixel is 11, the pixel group numbers 9, 10, 12, and 13 together include all of the emission pattern of the higher weighted subfields with the weights D3 through D6 (i.e., all of the higher weighted subfields with the weights D3 through D6 are on, only a higher weighted subfields with the weight D3 is off, only a higher weighted subfields with the weight D4 is off, only a higher weighted subfields with the weight D5 is off, and only a higher weighted subfields with the weight D6 is off), which can occur in a previous frame pixel, discontinuous transition in the emission pattern of the higher weighted subfields between the previous frame pixel and the current frame pixel can be effective eliminated by changing the gray level of the current frame pixel a little.

In an example of gray-level change, when a previous frame pixel after being coded has a continuous emission pattern of the higher weighted subfields, as shown in one of the group numbers 3, 6, 10, 15, 20, and 25 in FIG. 5, and when a current frame pixel before being coded has an emission pattern of the higher weighted subfields, in which among the higher weighted subfields with the respective weights D3 through D6, only one is turned off, the gray level of the current frame pixel is changed as follows.

a) When only a higher illuminating block with the weight D6 is turned off (i.e., when the pixel group number of the current frame pixel is 6, 11, 16, or 21), the gray level is changed according to Formula (7).

$$p_e'(i,j;t)=[\text{index}\{p_e(i,j;t)\}-1]\times D_3+D_3-1 \quad (7)$$

b) When only a higher illuminating block with the weight D5 is turned off (i.e., when the pixel group number of the current frame pixel is 7, 12, 17, or 22), the gray level is changed according to Formula (8).

$$p_e'(i,j;t)=[\text{index}\{p_e(i,j;t)\}-2]\times D_3+D_3-1 \quad (8)$$

c) When only a higher illuminating block with the weight D4 is turned off (i.e., when the pixel group number of the current frame pixel is 8, 13, 18, or 23), the gray level is changed according to Formula (9).

$$p_e'(i,j;t)=[\text{index}\{p_e(i,j;t)\}+2]\times D_3+D_3-1 \quad (9)$$

d) When only a higher illuminating block with the weight D3 is turned off (i.e., when the pixel group number of the current frame pixel is 9, 14, 19, or 24), the gray level is changed according to Formula (10).

$$p_e'(i,j;t)=[\text{index}\{p_e(i,j;t)\}+1]\times D_3+D_3-1 \quad (10)$$

Similarly, when a previous frame pixel after being coded has an emission pattern of the higher weighted subfields, in which only a higher illuminating block with the weight D6 is turned off, as shown in one of the group numbers 6, 11, 16, and 21 in FIG. 5, and when a current frame pixel before being coded has an emission pattern of the higher weighted subfields, in which among the higher weighted subfields with the respective weights D3 through D6, only one of higher weighted subfields with the respective weights D5, D4, and D3 is turned off, or has the continuous emission pattern, the gray level of the current frame pixel is changed as follows.

a) When only a higher weighted subfields with the weight D5 is turned off (i.e., when the pixel group number of the current frame pixel is 7, 11, 16, or 21), the gray level is changed according to Formula (11).

$$p_e'(i,j;t)=[\text{index}\{p_e(i,j;t)\}-1]\times D_3+D_3-1 \quad (11)$$

b) When only a higher weighted subfields with the weight D4 is turned off (i.e., when the pixel group number of the current frame pixel is 12, 17, or 22), the gray level is changed according to Formula (12).

$$p_e'(i,j;t)=[\text{index}\{p_e(i,j;t)\}-2]\times D_3+D_3-1 \quad (12)$$

c) When only a higher weighted subfields with the weight D3 is turned off (i.e., when the pixel group number of the current frame pixel is 1, 4, 8, 13, 18, or 23), the gray level is changed according to Formula (13).

$$p_e'(i,j;t)=[\text{index}\{p_e(i,j;t)\}+2]\times D_3+D_3-1 \quad (13)$$

d) When any continuous emission pattern occurs starting from the weighted subfields with the weight D3 (i.e., when the pixel group number of the current frame pixel is 3, 6, 10, 15, 20, or 25), the gray level is changed according to Formula (14).

$$p_e'(i,j;t)=[\text{index}\{p_e(i,j;t)\}+1]\times D_3+D_3-1 \quad (14)$$

Similarly, when a previous frame pixel after being coded has an emission pattern of the higher weighted subfields, in which only a higher weighted subfields with the weights D5, D4, or D3 is turned off, the gray level of a current frame pixel before being coded is changed in a similar manner to that described above.

During the gray-level change minimizing the transition in the emission pattern of the higher weighted subfields between previous and current frame pixels, the number of conditional formulae necessary for finding out a pixel group number minimizing emission pattern transition increases, and thus processing speed decreases with an increase in the resolution of a frame. To overcome this problem, the degree of illuminating pattern transition between previous and current frame pixels may be calculated when the current frame pixel has a large amount of motion, and then gray-level change may be performed to minimize the calculated degree of emission pattern transition.

In the case of weighted subfields with the highest weights D7 through D9 in the configuration of subfields according to the present invention, a discontinuous OFF state does not occur when a gray level increases. Accordingly, the emission pattern of the higher weighted subfields with the weights D3 through D6, which are major factors causing false contour, are divided into complete linear patterns (corresponding to the pixel group numbers 1, 3, 6, 10, 15, 20, and 25), weight D3-OFF patterns (corresponding to the pixel group numbers 0, 2, 5, 9, 14, 19, and 24), weight D4-OFF patterns (corresponding to the pixel group numbers 4, 8, 13, 18, and 23), weight D5-OFF patterns (corresponding to the pixel group numbers 7, 12, 17, and 22), and weight D6-OFF patterns (corresponding to the pixel group numbers 11, 16, and 21). The following table shows emission pattern for calculating the degree of emission pattern transition according to the present invention.

TABLE

| Emission pattern | Emission pattern bits |
|---|---|
| Complete linear pattern | 1111111 |
| Weight 8-OFF pattern | 1110111 |
| Weight 16-OFF pattern | 1111011 |
| Weight 24-OFF pattern | 1111101 |
| Weight 32-OFF pattern | 1111110 |

A pattern difference (PD) indicating transition in the emission pattern bits between a current frame pixel and a previous frame pixel is obtained as a gauge indicating the degree of emission pattern transition therebetween, which is necessary for gray-level change, using Formula (15).

$$PD=[A \text{ XOR } B][1\ 2\ 4\ 8\ 16\ 24\ 32]^T \quad (15)$$

Here, A and B denote the emission pattern bits of the previous frame pixel and the emission pattern bits of the current frame pixel, respectively. For example, when the pixel group number of the previous frame pixel is 6 having a complete linear pattern, and when the pixel group number of the current frame pixel is 7 having a weight D5-OFF pattern, A=[1 1 1 1 1 1 1], B=[1 1 1 1 1 0 1], and PD=[0 0 0 0 0 1 0][1 2 4 8 16 24 32]=24.

In other words, when emission pattern of the higher weighted subfields of the previous frame pixel is different from that of the current frame pixel, the PD has a non-zero value. Conversely, when the previous and current frame pixels have the same emission pattern, for example, when the previous and current frame pixels respectively have the pixel group number 11 having an off state at the weight 32 and the pixel group number 16 having an off state at the weight 32, A=[1 1 1 1 1 1 0], B=[1 1 1 1 1 1 0], and PD=[0 0 0 0 0 0 0][1 2 4 8 16 24 32]=0. Consequently, when the current and previous frame pixels have the same emission pattern, the PD has a zero value.

Figure 15:
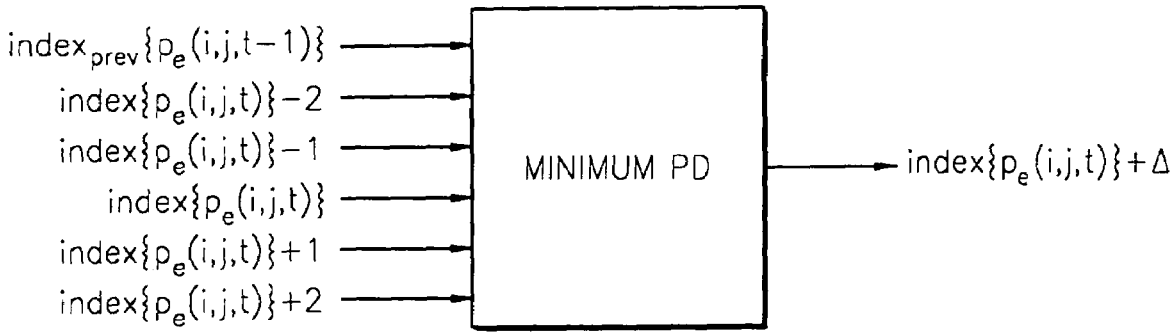
FIG. 15 shows a preferred embodiment of the configuration of calculation of emission pattern transition using emission pattern bits according to the present invention.

Based on the above-described relation, a pixel group number giving a minimum PD is obtained with respect to all of pixel group numbers within the range of variation of the pixel group number from −2 to 2, as shown in FIG. 15, using the pixel group numbers of the respective previous and current frame pixels. Here, FIG. 15 shows a preferred embodiment of the configuration of calculation of emission pattern transition using emission pattern bits according to the present invention. Then, gray-level change is performed according to Formula (16) using the increment Δ of a pixel group number minimizing a PD value within the range of variation of pixel group number from −2 to 2.

$$p_e'(i,j;t)=[\text{index}\{p_e(i,j;t)\}+\Delta]\times D_3+D_3-1 \quad (16)$$

Figure 14:
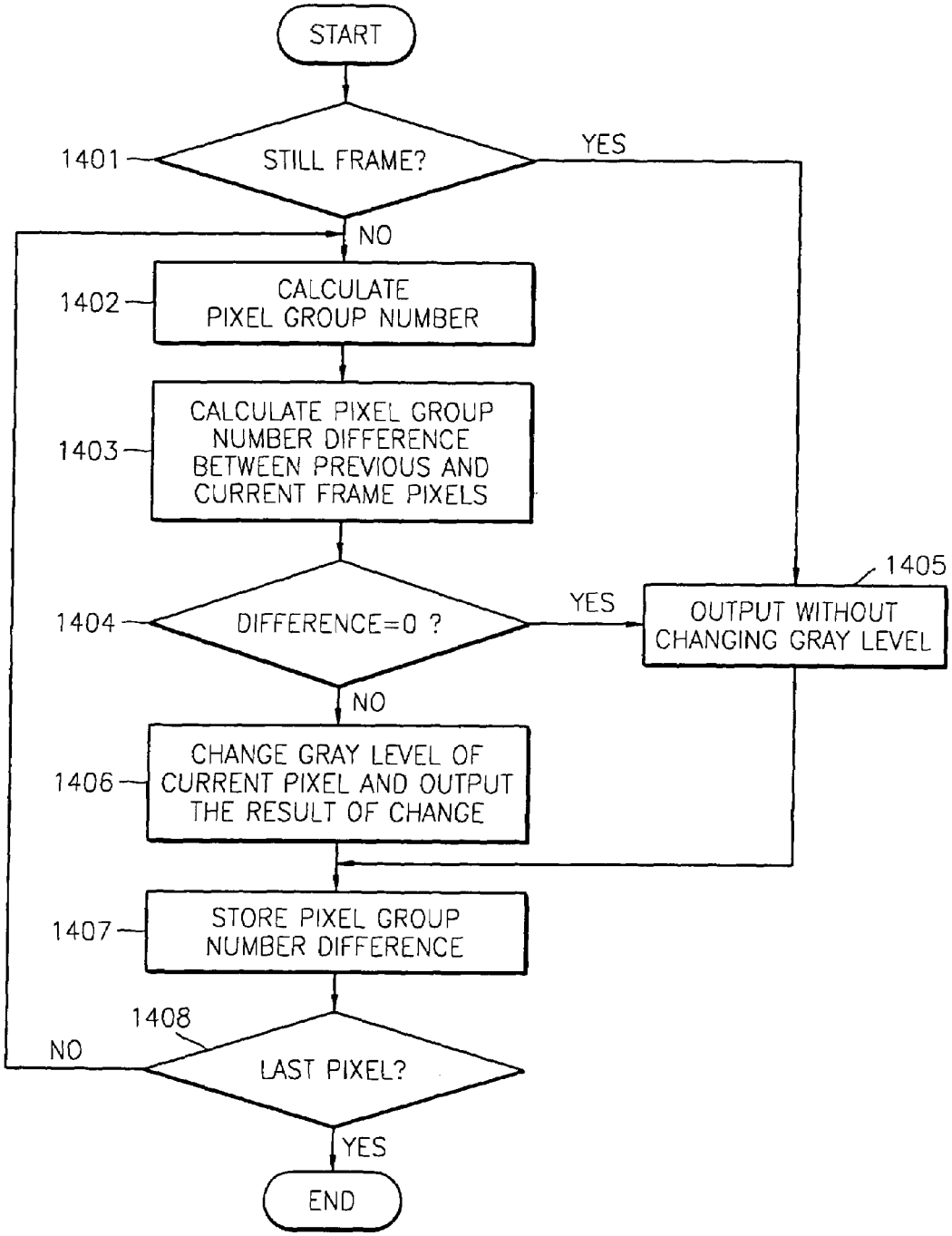
FIG. 14 is a flowchart of a method of eliminating false contour according to an embodiment of the present invention.

FIG. 14 is a flowchart of a method of eliminating false contour according to an embodiment of the present invention. It is determined whether an input image is a still frame using Formulae (1) through (4) in step 1401. Step 1401 may be omitted according to circumstances. If it is determined that the input image is a still frame, the input image is output without changing its gray level in step 1405. However, if it is determined that the input image is not a still frame, the pixel group number of a pixel of the input image is calculated in step 1402.

A difference between the calculated pixel group number of the current pixel and a pixel group number corresponding to the gray level of a previous frame pixel that was actually displayed at the same spatial position as the current pixel is calculated in step 1403.

It is determined whether the calculated difference is zero in step 1404. If it is determined that the calculated difference is zero, the gray level of the current pixel is output without changing it in step 1405. Conversely, if it is determined that the calculated difference is non-zero, the gray level of the current pixel is changed in step 1406.

The calculated pixel group number difference between the current pixel and the previous frame pixel is stored in step 1407. Thereafter, it is determined whether the current pixel is the last one of the input image in step 1408. If it is determined that the current pixel is not the last one, the method progresses to step 1402 to perform the operation on another pixel in the input image.

The preferred embodiment of the present invention have been explained regarding to a PDP, but it will be understood by those skilled in the art that they can be variously applied to any other digital display apparatuses using pulse number modulation, such as digital micromirror device (DMD) displays, without departing from the spirit and scope of the present invention.

The above-described preferred embodiments of the present invention can be realized as programs, which can be executed in a universal digital computer through a computer-readable recording medium. In addition, the structures of data used in the above-described embodiments of the present invention can be recorded in a computer-readable recording medium using various devices. The computer-readable recording medium may be a storage media, such as a magnetic storage medium (for example, a ROM, a floppy disc, or a hard disc), an optical readable medium (for example, a CD-ROM or DVD), or carrier waves (for example, transmitted through the Internet).

As described above, in the present invention, existence/non-existence of motion of a current input pixel is determined using difference information between the current input pixel and a previous frame pixel, without extracting motion information through a complicate procedure. When the existence of motion is determined, the emission pattern of higher weighted subfields are compared between actual PDP driving data regarding to the previous frame pixel and current input data, and the gray level of the current input pixel is changed to have the same emission pattern of weighted subfields as the actual PDP driving data regarding to the previous frame pixel, thereby eliminating false contour. In the configuration of subfields according to the present invention, emission pattern transition of the higher weighted subfields is regular with an increase in an input gray level, and thus an error due to gray-level change can be reduced. Consequently, the degree of perception of diffused noise due to error diffusion is reduced. In the case of a still image, original input data is output as it is, thereby preventing problems caused by the lack of gray levels.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An apparatus for reducing false contour in a digital display panel, the apparatus comprising:

a data converter, which processes an image signal such that a gray level of the image signal exists within a predetermined range;

an error diffuser, which diffuses an error between a gray level of a current pixel in a current frame of the image signal received from the data converter and a gray level of the current pixel in the current frame after being subjected to gray-level change, to pixels adjacent to the current pixel in the current frame;

a first gray-level changing unit, which receives the image signal from the error diffuser, calculates a difference in a gray level between each pixel in the current frame of the image signal and a pixel corresponding to the current frame pixel in a previous frame of the image signal using a block of pixels, comprising a plurality of pixels, of predetermined size having the current frame pixel inside the block of pixels for the current frame and the previous frame, and changes the gray level of the current frame pixel based on the gray level difference such that transition in an emission pattern of higher weighted subfields among subfields, which illuminate according to the gray level of the current frame pixel, between the current frame pixel and the previous frame pixel is minimized; and a subfield converter, which converts a subfield according to a gray level output from the first gray-level changing unit.

2. The apparatus of claim 1, wherein the subfield converter represents the gray levels of subfields in the image signal with weights D0 through D9 in an increasing order from a lower to a higher value according to a predetermined rule such that highest weights D7, D8, and D9 do not allow emission pattern transition to occur with an increase in the gray level of the image signal, and such that higher weights D3, D4, D5, and D6 allow an off state to have a regular distribution with the increase in the gray level of the image signal.

3. The apparatus of claim 1, wherein the subfield converter represents the gray levels of subfields in the image signal with weights D0 through D9 in an increasing order from a lower to a higher value according to a predetermined rule such that an emission pattern is changed only at the weights D0, D1, D2, D3, D4, D5, and D6 with a change in the gray level of the image signal.

4. The apparatus of claim 1, wherein the first gray-level changing unit comprises:

a frame memory part, which receives the image signal from the data converter and stores information on a currently input frame as previous frame information for a next input frame;

an pixel transition determiner, which receives current frame information of the image signal from the error diffuser and the previous frame information from the frame memory part and determines a degree of gray-level transition between each pixel in the current frame and a corresponding pixel in the previous frame;

a still image determiner, which receives the degree of gray-level transition from the pixel transition determiner and determines whether the current frame is a still image based on the degree of gray-level transition and a predetermined level;

a pixel group number storage part, which stores pixel group number information regarding to each pixel in the previous frame based on the gray level of the pixel after being subjected to the gray-level change; and a second gray-level changing unit, which when the still image determiner determines the current frame as not a still image, changes the gray level of the current frame according to a predetermined method using the current frame information output from the error diffuser, the degree of gray-level transition output from the pixel transition determiner, the previous frame information stored in the frame memory part, and the pixel group number information stored in the pixel group number storage part.

5. The apparatus of claim 4, wherein the second gray-level changing unit outputs a gray level of the previous frame when the still image determiner determines the current frame as a still image.

6. The apparatus of claim 4, wherein the pixel transition determiner determines the degree of gray-level transition between a particular pixel in the current frame, i.e., a current frame pixel, and a corresponding pixel in the previous frame, i.e., a previous frame pixel, using an average of gray level of all pixels included in a square block that has a predetermined size and has the current frame pixel at its center, an average of absolute values of a difference between the gray level of the current frame pixel and the gray levels of all of the pixels included in the square block except for the current frame pixel, an average of absolute values of differences between the gray levels of all of the pixels included in the square block and respective gray levels of all pixels included in a square block that has the predetermined size and has the previous frame pixel at its center, and an absolute value of a difference between the gray level of the current frame pixel and the gray level of the previous frame pixel.

7. The apparatus of claim 4, wherein the still image determiner determines the current frame as a still image when a ratio of the number of pixels, which are determined as having less motion than a predetermined amount in the current frame of the image signal received from the pixel transition determiner, to a total number of pixels in the current frame is greater than the predetermined value.

8. The apparatus of claim 4, wherein the second gray-level changing unit compares the degree of gray-level transition from the pixel transition determiner with a predetermined level and changes the gray level of each pixel in the current frame based on the result of the comparison.

9. The apparatus of claim 4, wherein the second gray-level changing unit compares the degree of gray-level transition from the pixel transition determiner with a predetermined level and when the degree of gray-level transition is lower than the predetermined level and when a pixel group number of a pixel in the current frame, i.e., the current frame pixel, is different from a pixel group number of a corresponding pixel in the previous frame, i.e., the previous frame pixel, changes the pixel group number of the current frame pixel to a pixel group number close to the pixel group number of the previous frame pixel among pixel group numbers adjacent to the pixel group number of the current frame pixel.

10. The apparatus of claim 5, wherein when the subfield converter represents the gray levels of subfields in the image signal with weights D0 through D9 in an increasing order from a lower to a higher value according to a predetermined rule, the second gray-level changing unit changes weights representing the gray level of the current frame pixel such that an emission pattern of the current frame is the same as that of the previous frame with respect to the weights D3, D4, and D5.

11. The apparatus of claim 4, wherein when the subfield converter represents the gray levels of subfields in the image signal with weights D0 through D9 in an increasing order from a lower to a higher value according to a predetermined rule, the second gray-level changing unit changes weights representing the gray level of the current frame pixel such that a distribution of on states at the weights D3, D4, D5, and D6 is regular in a diagonal direction when the on states of the weights D0 through D9 are arranged in an increasing order of the gray levels.

12. The apparatus of claim 4, wherein when the gray level of the image signal is divided into 25 gray levels according to a predetermined standard and then pixel group numbers from zero are sequentially allocated to the 25 gray levels, the second gray-level changing unit does not change gray levels corresponding to the pixel group numbers 0 and 1.

13. The apparatus of claim 12, wherein the second gray-level changing unit obtains pixel group number information of the previous frame pixel after being subjected to gray-level change using the following formula:

$$\mathrm{Index}_{prev}\{p_e'(i,j;t-1)\}=\mathrm{Index}\{p(i,j;t-1)\}\mathrm{Index}_{diff}\{p_e'(i,j;t-1)\},$$

where the Index function indicates a pixel group number corresponding to an input gray value, $\mathrm{Index}_{diff}$ indicates a difference between the pixel group number of an original previous frame pixel before being subjected to error diffusion and a pixel group number corresponding to a gray value obtained after the original previous frame pixel is coded and subjected to gray-level change, $p_e'(i,j;t-1)$ indicates the gray level of the previous frame pixel after being subjected to gray-level change and error diffusion, and $p(ij;t-1)$ indicates the gray level of the original previous frame pixel.

14. The apparatus of claim 4, wherein when the degree of gray-level transition received from the pixel transition determiner is lower than the predetermined level, the second gray-level changing unit changes the gray level of the current frame using the following formula:

$$\mathrm{if}(\mathrm{index}_{prev}\{p_e'(i,j;t-1)\}<\mathrm{index}\{p_e(i,j;t)\})\ p_e'(i,j;t)=[\mathrm{index}\{p_e(i,j;t)\}-1]\times D_3+D_{3-1}$$

$$\mathrm{if}(\mathrm{index}_{prev}\{p_e'(i,j;t-1)\}>\mathrm{index}\{p_e(i,j;t)\}),\ p_e'(i,j;t)=[\mathrm{index}\{p_e(i,j;t)\}+1]\times D_3$$

$$\mathrm{if}(\mathrm{index}_{prev}\{p_e'(i,j;t-1)\}=\mathrm{index}\{p_e(i,j;t)\})\ p_e'(i,j;t)=p_e(i,j;t)$$

where the Index function indicates a pixel group number corresponding to an input gray value, $\mathrm{Index}_{diff}$ indicates a difference between the pixel group number of an original previous frame pixel before being subjected to error diffusion and a pixel group number corresponding to a gray obtained after the original previous frame pixel is coded and subjected to gray-level change, $p_e'(i,j;t-1)$ indicates the gray level of the previous frame pixel after being subjected to gray-level change and error diffusion, $p(ij;t-1)$ indicates the gray level of the original previous frame pixel, and $D_3$ indicates a fourth weight when the subfield converter represents the gray levels of subfields in the image signal with weights D0 through D9 in an increasing order from a lower to a higher value according to a predetermined rule.

15. The apparatus of claim 4, wherein when the subfield converter represents the gray levels of subfields in the image signal with weights D0 through D9 in an increasing order from a lower to a higher value according to a predetermined rule, the second gray-level changing unit changes the gray level of the current frame pixel according to the following formula using a pixel group number corresponding to an emission pattern of higher weighted subfields such that a difference between the emission pattern of weights corresponding to the gray level of the previous frame pixel after being subjected to gray-level change and the emission pattern of weights corresponding to the gray level of the current frame pixel is minimized:

$$p_e'(i,j;t)=[\text{index}\{p_e(i,j;t)\}+\Delta]\times D_3+D_3-1,$$

where $p_e'(i,j;t)$ indicates the gray level of the current frame pixel obtained as the result of the gray-level change, index$\{p_e(i,j;t)\}$ indicates a pixel group number corresponding to the gray level of the current frame pixel, $D_3$ indicates a fourth weight, and $\Delta$ indicates an increment of a pixel group number minimizing a PD value within the range of variation of pixel group number from −2 to 2.

16. A method of reducing false contour in a digital display panel, the method comprising:

(a) processing an image signal such that a gray level of the image signal exists within a predetermined range;

(b) diffusing an error between a gray level of a current pixel in a current frame of the image signal resulting from step (a) and a gray level of the current pixel in the current frame after being subjected to gray-level change to pixels adjacent to the current pixel in the current frame;

(c) calculating a difference in a gray level between each pixel in the current frame of the image signal resulting from step (b) and a pixel corresponding to the current frame pixel in a previous frame of the image signal resulting from step (b) using a block of pixels, comprising a plurality of pixels, of predetermined size surrounding the current frame pixel for the current frame and the previous frame, and changing the gray level of the current frame pixel based on the gray level difference such that higher weighted subfields among subtields, which illuminate according to the gray level of the current frame pixel, are on a continuous on or off state; and (d) converting a subfield according to a gray level resulting from step (c).

17. The method of claim 16, wherein step (d) comprises representing the gray levels of subfields in the image signal with weights D0 through D9 in an increasing order from a lower to a higher value according to a predetermined rule such that highest weights D7, D8, and D9 do not allow emission pattern transition to occur with an increase in the gray level of the image signal, and such that higher weights D3, D4, D5, and D6 allow an off state to have a regular distribution with the increase in the gray level of the image signal.

18. The method of claim 16, wherein step (d) comprises representing the gray levels of subfields in the image signal with weights D0 through D9 in an increasing order from a lower to a higher value according to a predetermined rule such that an emission pattern is changed only at the weights D0, D1, D2, D3, D4, D5, and D6 with a change in the gray level of the image signal.

19. The method of claim 16, wherein step (c) comprises:

(c1) storing information on a currently input frame of the image signal resulting from step (a) as previous frame information for a next input frame;

(c2) determining a degree of gray-level transition between each pixel in the current frame and a corresponding pixel in the previous frame based on current frame information of the image signal resulting from step (a) and the previous frame information resulting from step (c1);

(c3) determining whether the current frame is a still image based on the degree of gray-level transition and a predetermined level;

(c4) storing pixel group number information regarding to each pixel in the previous frame based on the gray level of the pixel after being subjected to the gray-level change; and (c5) when the current frame is determined as not a still image, changing the gray level of the current frame according to a predetermined method using the current frame information, the degree of gray-level transition, the previous frame information, and the pixel group number information.

20. A computer-readable recording medium on which a program for executing the method of claim 16 in a computer is recorded.

21. The method of claim 19, wherein step (c5) comprises outputting a gray level of the previous frame when the current frame is determined as a still image in step (c3).

22. The method of claim 19, wherein step (c2) comprises determining the degree of gray-level transition between a particular pixel in the current frame, i.e., a current frame pixel, and a corresponding pixel in the previous frame, i.e., a previous frame pixel, using an average of gray level of all pixels included in a square block that has a predetermined size and has the current frame pixel at its center, an average of absolute values of a difference between the gray level of the current frame pixel and the gray levels of all of the pixels included in the square block except for the current frame pixel, an average of absolute values of differences between the gray levels of all of the pixels included in the square block and respective gray levels of all pixels included in a square block that has the predetermined size and has the previous frame pixel at its center, and an absolute value of a difference between the gray level of the current frame pixel and the gray level of the previous frame pixel.

23. The method of claim 19, wherein step (c3) comprises determining the current frame as a still image when a ratio of the number of pixels, which are determined as having less motion than a predetermined amount in the current frame of the image signal in step (c2), to a total number of pixels in the current frame is greater than a predetermined value.

24. The method of claim 19, wherein step (c5) comprises comparing the degree of gray-level transition resulting from step (c2) with a predetermined level and changing the gray level of each pixel in the current frame based on the result of the comparison.

25. The method of claim 19, wherein step (c5) comprises comparing the degree of gray-level transition resulting from step (c2) with a predetermined level and when the degree of gray-level transition is lower than the predetermined level and when a pixel group number of a pixel in the current frame, i.e., the current frame pixel, is different from a pixel group number of a corresponding pixel in the previous frame, i.e., the previous frame pixel, changing the pixel group number of the current frame pixel to a pixel group number close to the pixel group number of the previous frame pixel among pixel group numbers adjacent to the pixel group number of the current frame pixel.

26. The method of claim 19, wherein when the gray levels of subfields in the image signal are represented with weights D0 through D9 in an increasing order from a lower to a higher value according to a predetermined rule, step (c5)

comprises changing weights representing the gray level of the current frame pixel such that an emission pattern of the current frame is the same as that of the previous frame with respect to the weights D3, D4, and D5.

27. The method of claim 19, wherein when the gray levels of subfields in the image signal are represented with weights D0 through D9 in an increasing order from a lower to a higher value according to a predetermined rule, step (c5) comprises changing weights representing the gray level of the current frame pixel such that a distribution of on states at the weights D3, D4, D5, and D6 is regular in a diagonal direction when the on states of the weights D0 through D9 are arranged in an increasing order of the gray levels.

28. The method of claim 19, wherein when the gray level of the image signal is divided into 25 gray levels according to a predetermined standard and then pixel group numbers from zero are sequentially allocated to the 25 gray levels, step (c5) comprises not changing gray levels corresponding to the pixel group numbers 0 and 5.

29. The method of claim 28, wherein step (c5) comprises obtaining pixel group number information of the previous frame pixel after being subjected to gray-level change using the following formula:

$$\text{Index}_{prev}\{p_e'(i,j;t-1)\}=\text{Index}\{p(i,j;t-1)\}-\text{Index}_{diff}\{p_e'(i,j;t-1)\},$$

where the Index function indicates a pixel group number corresponding to an input gray value, $\text{Index}_{diff}$ indicates a difference between the pixel group number of an original previous frame pixel before being subjected to error diffusion and a pixel group number corresponding to a gray value obtained after the original previous frame pixel is coded and subjected to gray-level change, $p_e'(i,j;t-1)$ indicates the gray level of the previous frame pixel after being subjected to gray-level change and error diffusion, and $p(i,j;t-1)$ indicates the gray level of the original previous frame pixel.

30. The method of claim 19, wherein when the degree of gray-level transition resulting from step (c2) is lower than the predetermined level, step (c5) comprises changing the gray level of the current frame using the following formula:

$$\text{if}(\text{index}_{prev}\{p_e'(i,j;t-1)\}<\text{index}\{p_e(i,j;t)\})\ p_e'(i,j;t)=[\text{index}\{p_e(i,j;t)\}-1]\times D_3+D_{3-1}$$

$$\text{if}(\text{index}_{prev}\{p_e'(i,j;t-1)\}>\text{index}\{p_e(i,j;t)\}),\ p_e'(i,j;t)=[\text{index}\{p_e(i,j;t)\}+1]\times D_3$$

$$\text{if}(\text{index}_{prev}\{p_e'(i,j;t-1)\}=\text{index}\{p_e(i,j;t)\})\ p_e'(i,j;t)=p_e(i,j;t)$$

where the Index function indicates a pixel group number corresponding to an input gray value, $\text{Index}_{diff}$ indicates a difference between the pixel group number of an original previous frame pixel before being subjected to error diffusion and a pixel group number corresponding to a gray value obtained after the original previous frame pixel is coded and subjected to gray-level change, $p_e'(i,j;t-1)$ indicates the gray level of the previous frame pixel after being subjected to gray-level change and error diffusion, $p(ij;t-1)$ indicates the gray level of the original previous frame pixel, and $D_3$ indicates a fourth weight when the subfield converter represents the gray levels of subfields in the image signal with weights D0 through D9 in an increasing order from a lower to a higher value according to a predetermined rule.

31. An apparatus for driving a digital display panel, the apparatus comprising:

an image signal input unit, which separates only an analog image signal from an input composite image signal;

an analog-to-digital converter, which converts the analog image signal to a digital image signal;

a gamma correction unit, which corrects the digital image signal to suit for the characteristics of a plasma display panel (PDP);

a false contour elimination unit, which converts subfields by changing a gray level of the corrected digital image signal depending on a degree of gray-level transition between a group of pixels, comprising a plurality of pixels, surrounding each current frame pixel and a group of pixels surrounding a corresponding previous frame pixel in the image signal so that false contour is minimized; and a display control unit, which displays the subfield-converted image signal received from the false contour elimination unit on the PDP.

32. The apparatus of claim 31, wherein the false contour elimination unit comprises:

a data converter, which processes the image signal such that a gray level of the image signal exists within a predetermined range;

an error diffuser, which diffuses an error between a gray level of a current pixel in a current frame of the image signal received from the data converter and a gray level of the current pixel in the current frame after being subjected to gray-level change, to pixels adjacent to the current pixel in the current frame;

a first gray-level changing unit, which receives the image signal from the error diffuser, calculates a difference in a gray level between each pixel in the current frame of the image signal and a pixel corresponding to the current frame pixel in a previous frame of the image signal, and changes the gray level of the current frame pixel based on the gray level difference such that higher weighted subfields among subfields, which illuminate according to the gray level of the current frame pixel, are on a continuous on or off state; and a subfield converter, which converts a subfield according to a gray level output from the first gray-level changing unit.

33. The apparatus of claim 32, wherein the first gray-level changing unit comprises:

a frame memory part, which receives the image signal from the data converter and stores information on a currently input frame as previous frame information for a next input frame;

an pixel transition determiner, which receives current frame information of the image signal from the error diffuser and the previous frame information from the frame memory part and determines a degree of gray-level transition between each pixel in the current frame and a corresponding pixel in the previous frame;

a still image determiner, which receives the degree of gray-level transition from the pixel transition determiner and determines whether the current frame is a still image based on the degree of gray-level transition and a predetermined level;

a pixel group number storage part, which stores pixel group number information regarding to each pixel in the previous frame based on the gray level of the pixel after being subjected to the gray-level change; and a second gray-level changing unit, which when the still image determiner determines the current frame as not a still image, changes the gray level of the current frame according to a predetermined method using the current frame information output from the error diffuser, the degree of gray-level transition output from the pixel transition determiner, the previous frame information stored in the frame memory part, and the pixel group number information stored in the pixel group number storage part.

34. The apparatus of claim 33, wherein the second gray-level changing unit changes the gray level of the current frame pixel based on a pixel group number which is obtained using the pixel group numbers of the respective previous and current frame pixels such that it gives a minimum pattern difference with respect to all of pixel group numbers within a range of variation from −2 to 2.

* * * * *